US006603267B2

(12) United States Patent
Hilbig et al.

(10) Patent No.: US 6,603,267 B2
(45) Date of Patent: Aug. 5, 2003

(54) LOW-PRESSURE GAS DISCHARGE LAMP WITH A COPPER-CONTAINING GAS FILLING

(75) Inventors: Rainer Hilbig, Aachen (DE); Robert Peter Scholl, Roetgen (DE); Achim Koerber, Kerkrade (NL); Johannes Baier, Wuerselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 1 day.

(21) Appl. No.: 09/947,776

(22) Filed: Sep. 7, 2001

(65) Prior Publication Data

US 2002/0047524 A1 Apr. 25, 2002

(30) Foreign Application Priority Data

Aug. 8, 2000 (DE) ..... 100 44 563

(51) Int. Cl.[7] ..... H01J 17/20; H01J 61/12
(52) U.S. Cl. ..... 313/637; 313/638; 313/568
(58) Field of Search ..... 313/637, 638, 313/568

(56) References Cited

U.S. PATENT DOCUMENTS 4,891,554 A * 1/1990 Levand et al. ..... 313/634
5,929,563 A * 7/1999 Genz ..... 313/571
6,483,241 B1 * 11/2002 Stockwald ..... 313/638

FOREIGN PATENT DOCUMENTS

GB 2014358 A 8/1979

* cited by examiner

*Primary Examiner*—Vip Patel
*Assistant Examiner*—Kevin Quarterman
(74) *Attorney, Agent, or Firm*—Ernestine C. Bartlett

(57) ABSTRACT

A low-pressure gas discharge lamp having a gas discharge vessel containing a gas filling including a copper compound. The copper compound is selected from the oxides, chalcogenides, hydroxides, hydrides and the metalorganic compounds of copper. In addition to the copper compound, the gas filling includes a buffer gas such as argon, and may also include a thallium compound and/or a copper halogenide.

6 Claims, 1 Drawing Sheet

LOW-PRESSURE GAS DISCHARGE LAMP WITH A COPPER-CONTAINING GAS FILLING

TECHNICAL FIELD

Figure 1:
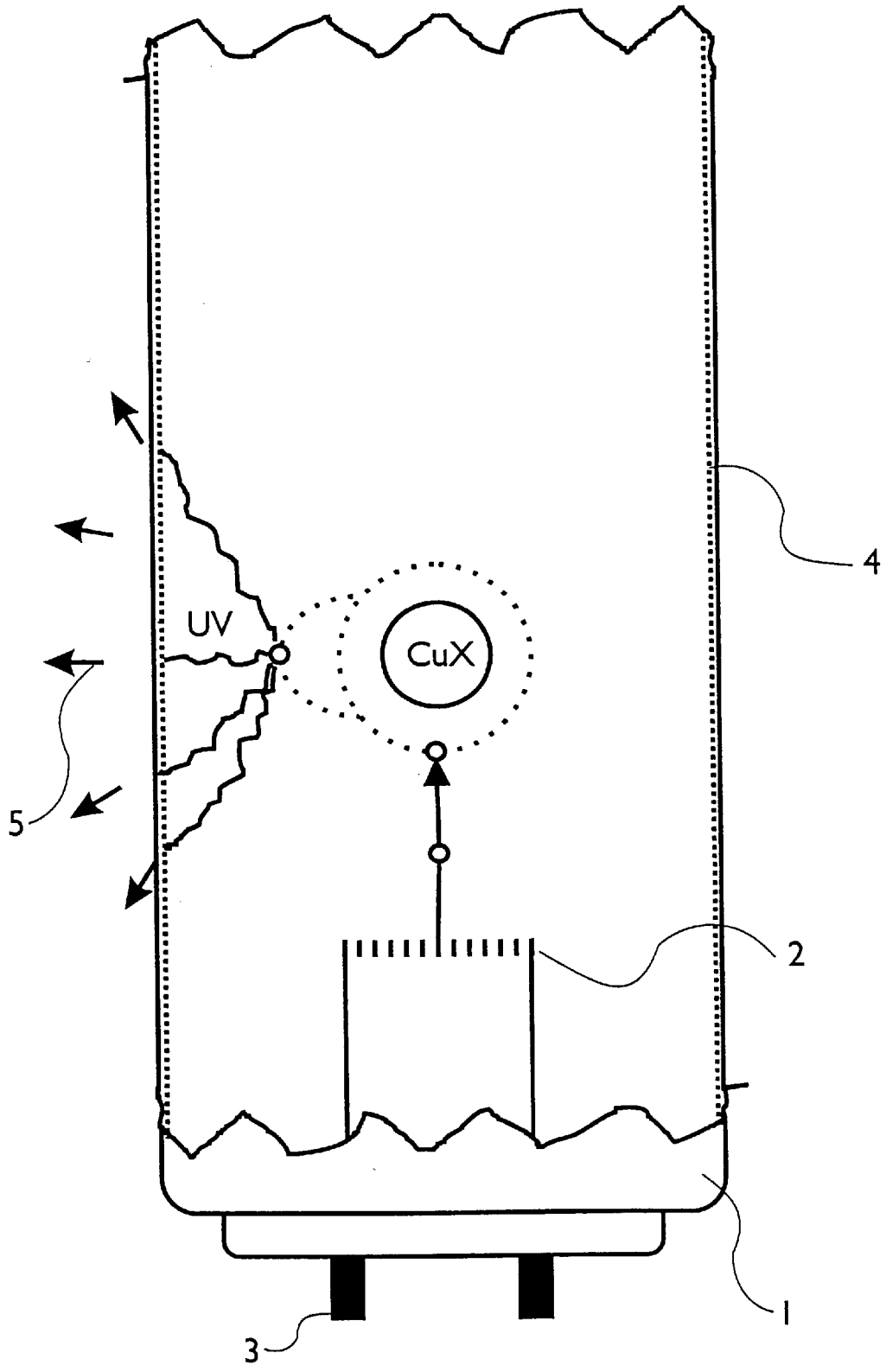

The invention relates to a low-pressure gas discharge lamp comprising a gas discharge vessel with a copper-containing gas filling, electrodes and means for generating and maintaining a low-pressure gas discharge.

BACKGROUND AND SUMMARY

Light generation in low-pressure gas discharge lamps is based on the principle that charge carriers, particularly electrons but also ions, are accelerated so strongly by an electric field between the electrodes of the lamp that collisions with the gas atoms or molecules in the gas filling of the lamp cause these gas atoms or molecules to be excited or ionized. When the atoms or molecules of the gas filling return to the ground state, a more or less substantial part of the potential energy is converted to radiation.

Conventional low-pressure gas discharge lamps comprise mercury in the gas filling and, in addition, a phosphor coating on the inside of the gas discharge vessel. A drawback of the mercury low-pressure gas discharge lamps resides in that mercury vapor primarily emits radiation in the high-energy, yet invisible UV-C range of the electromagnetic spectrum. This primary radiation must first be converted by the phosphors to visible radiation with a much lower energy level. In this process, the energy difference is converted to undesirable thermal radiation.

In addition, the mercury in the gas filling is being regarded more and more as an environmentally harmful and toxic substance that should be avoided as much as possible in present-day mass-products as its use, production and disposal pose a threat to the environment.

It is known already that the spectrum of low-pressure gas discharge lamps can be influenced by substituting the mercury in the gas filling with other substances.

For example, GB 2 014 658 A discloses a low-pressure gas discharge lamp comprising a discharge vessel, electrodes and a filling which contains at least a copper halogenide as the UV emitter. This copper halogenide-containing low-pressure gas discharge lamp emits in the visible range as well as in the UV range at 324.75 and 327.4 nm.

It is an object of the invention to provide a low-pressure gas discharge lamp the radiation of which is as close as possible to the visible region of the electromagnetic spectrum.

In accordance with the invention, this object is achieved by a low-pressure gas discharge lamp provided with a gas discharge vessel comprising a gas filling with a copper compound selected from the group formed by the oxides, chalcogenides, hydroxides, hydrides and metalorganic compounds of copper, and comprising a buffer gas, which low-pressure gas discharge lamp is further provided with electrodes and means for generating and maintaining a low-pressure gas discharge.

In the lamp in accordance with the invention, a molecular gas discharge takes place at a low pressure, which gas discharge emits radiation in the visible and near UVA region of the electromagnetic spectrum. Apart from the characteristic lines of copper at 325, 327, 510, 570 and 578 nm, said radiation also includes a wide continuous spectrum in the blue range of the electromagnetic spectrum from 400 to 550 nm. As this radiation originates from a molecular discharge, the type of copper compound, possible further additives as well as the internal pressure of the lamp and the operating temperature enable the exact position of the continuous spectrum to be controlled.

In combination with phosphors, the lamp in accordance with the invention has a visual efficiency which is substantially higher than that of conventional low-pressure mercury discharge lamps. The visual efficiency, expressed in lumen/Watt, is the ratio between the brightness of the radiation in a specific visible wavelength range and the energy for generating the radiation. The high visual efficiency of the lamp in accordance with the invention means that a specific quantity of light is obtained at a smaller power consumption. Besides, the use of mercury is avoided.

In a lamp comprising a gas filling containing a copper compound selected from the group formed by the oxides, chalcogenides, hydroxides, hydrides and the metal-organic compounds of copper, and containing a buffer gas, the gas discharge takes place with a very high radiant intensity per unit area. For this reason, the lamp in accordance with the invention can be advantageously used as a backlight for liquid crystal display screens.

For general illumination purposes, the lamp is combined with appropriate phosphors. As the losses caused by Stokes' displacement are small, visible light having a high light output is obtained.

A further improved efficiency at lower operating temperatures is achieved if the gas filling comprises a mixture of a copper compound selected from the group formed by the halogenides, oxides, chalcogenides, hydroxides, hydrides and the metalorganic compounds of copper with a copper halogenide.

It may be alternatively preferred for the gas filling to comprise, as a further additive, a compound of thallium, which is selected from the group formed by the halogenides, oxides, chalcogenides, hydroxides, hydrides and the metalorganic compounds of thallium. As a result, a gas discharge with a wide continuous spectrum is obtained.

For the buffer gas the gas filling may comprise an inert gas selected from the group formed by helium, neon, argon, krypton and xenon.

Within the scope of the invention it may be preferred that the gas discharge vessel comprises a phosphor coating on the outside surface. The UVA radiation emitted by the low-pressure gas discharge lamp in accordance with the invention is not absorbed by the customary glass types, but goes through the walls of the discharge vessel substantially without any losses. Therefore, the phosphor coating can be provided on the outside of the gas discharge vessel. This results in a simplification of the manufacturing process.

Within the scope of the invention it is particularly preferred that the gas filling contains a copper compound, selected from the group formed by the oxides, chalcogenides, hydroxides, hydrides and the metalorganic compounds of copper, in a concentration in the range from 1 to 10 $\mu g/cm^3$, and argon at a partial pressure in the range from 1 to 10 mbar.

BRIEF DESCRIPTION OF THE DRAWING FIGURES

These and other aspects of the invention will be apparent from and elucidated with reference to one drawing and one embodiment.

In the drawing:

FIG. 1 diagrammatically shows the light generation in a low-pressure gas discharge lamp comprising a gas filling containing a copper (I) compound.

DETAILED DESCRIPTION

In the embodiment shown in FIG. 1, the low-pressure gas discharge lamp in accordance with the invention is composed of a tubular lamp envelope 1, which surrounds a discharge space. At both ends of the tube, inner electrodes 2 are sealed in, via which electrodes the gas discharge can be ignited. The low-pressure gas discharge lamp comprises the lamp holder and the lamp cap 3. An electrical ballast is integrated in known manner in the lamp holder or in the lamp cap, which ballast is used to control the ignition and the operation of the gas discharge lamp. In a further embodiment, not shown in FIG. 1, the low-pressure gas discharge lamp can alternatively be operated and controlled via an external ballast.

In accordance with another embodiment of the invention, the gas discharge vessel may alternatively be a multiple-bent or coiled tube enveloped by an outer bulb.

The wall of the gas discharge vessel is preferably composed of a glass type which is transparent to UVA radiation. The gas filling comprises, in the simplest case, a copper compound selected from the group formed by the oxides, chalcogenides, hydroxides, hydrides and the metalorganic compounds of copper in a quantity in the range from 1 to 10 $\mu g/cm^3$, and the gas filling also comprises an inert gas. The inert gas serves as a buffer gas, which facilitates the ignition of the gas discharge. Argon is preferably used as the buffer gas. Argon may be substituted, entirely or partly, with another inert gas, such as helium, neon or krypton.

The lumen efficiency can be dramatically improved by adding an additive to the gas filling, which is selected from the group formed by the halogenides of copper and the halogenides, oxides, chalcogenides, hydroxides, hydrides and the metalorganic compounds of thallium.

The efficiency can be further improved by optimizing the internal pressure of the lamp during operation. The cold filling pressure is maximally 10 mbar. Preferably, said pressure lies in a range between 1.0 and 2.5 mbar.

It has been found that, in accordance with a further advantageous measure, an increase of the lumen efficiency of the low-pressure gas discharge lamp can be achieved by controlling the operating temperature of the lamp using suitable constructional measures. The diameter and the length of the lamp are chosen to be such that, during operation at an outside temperature of 25° C., an inside temperature in the range from 350 to 450° C. is attained. This inside temperature relates to the coldest spot of the gas discharge vessel as the discharge brings about a temperature gradient in the vessel.

To increase the inside temperature, the gas discharge vessel may also be coated with an infrared radiation-reflecting coating. Preferably, use is made of an infrared radiation-reflecting coating of indium-doped tin oxide.

A suitable material for the electrodes in the low-pressure gas discharge lamp in accordance with the invention comprises nickel, a nickel alloy or a metal having a high melting point, in particular tungsten and tungsten alloys. Also composite materials of tungsten with thorium oxide, indium oxide or copper oxide can suitably be used.

In the embodiment in accordance with FIG. 1, the outside surface of the gas discharge vessel of the lamp is coated with a phosphor layer 4. The UV-radiation originating from the gas discharge causes the phosphors in the phosphor layer to emit light in the visible region 5.

The chemical composition of the phosphor layer determines the spectrum of the light or its tone. The materials that can suitably be used as phosphors must absorb the radiation generated and emit said radiation in a suitable wavelength range, for example for the three basic colors red, blue and green, and enable a high fluorescence quantum yield to be achieved.

Suitable phosphors and phosphor combinations must not necessarily be applied to the inside of the gas discharge vessel; they may alternatively be applied to the outside of the gas discharge vessel as the customary glass types do not absorb UVA radiation.

In accordance with another embodiment, the lamp is capacitively excited using a high frequency field, the electrodes being provided on the outside of the gas discharge vessel.

In accordance with a further embodiment, the lamp is inductively excited using a high frequency field.

When the lamp is ignited, the electrons emitted by the electrodes cause the molecules of the gas filling to emit UV radiation from the characteristic radiation and a continuous spectrum in the range between 400 and 550 nm.

The discharge heats up the gas filling such that the desired vapor pressure and the desired operating temperature ranging from 350° C. to 450° C. is achieved at which the light output is optimal.

In operation, the radiation from the gas filling comprising a copper compound selected from the group formed by the oxides, chalcogenides, hydroxides, hydrides and the metalorganic compounds of copper, and comprising a buffer gas, exhibits, apart from the line spectrum of the elementary copper at 325, 327, 510, 570 and 578 nm, an intensive, wide, continuous molecular spectrum between 400 and 550 nm, which is brought about by molecular discharge of the copper compound.

EXAMPLE 1

A cylindrical discharge vessel made from a type of glass that is transparent to UVA radiation, having a length of 15 cm and a diameter of 2.5 cm, is provided with electrodes of tungsten. The discharge vessel is evacuated and simultaneously a dose of 3 $\mu g/cm^3$ copper(I) oxide, 3 $\mu g/cm^3$ copper(I) bromide and 3 $\mu g$ thallium(I) bromide is added. Also argon is introduced at a partial pressure of 10 mbar.

An alternating current originating from an external alternating current source is supplied and, at an operating temperature of 420° C., a lumen efficiency of 85 lm/W is measured.

What is claimed is:

1. A low-pressure gas discharge lamp provided with a gas discharge vessel comprising a gas filling with a copper compound selected from the group formed by the oxides, chalcogenides, hydroxides, hydrides and the metalorganic compounds of copper, and a buffer gas, which low-pressure gas discharge lamp is further provided with electrodes and means for generating and maintaining a low-pressure gas discharge.

2. A low-pressure gas discharge lamp as claimed in claim 1, characterized in that the gas filling comprises, as a further additive, a halogenide selected from the halogenides of copper.

3. A low-pressure gas discharge lamp as claimed in claim 1, characterized in that the gas filling comprises, as a further additive, a compound of thallium selected from the group formed by the halogenides, oxides, chalcogenides, hydroxides, hydrides and the metalorganic compounds of thallium.

4. A low-pressure gas discharge lamp as claimed in claim 1, characterized in that the gas filling comprises, as a buffer gas, an inert gas selected from the group formed by helium neon, argon, krypton and xenon.

5. A low-pressure gas discharge lamp as claimed in claim 1, characterized in that the gas discharge vessel comprises a phosphor coating applied to the outside surface.

6. A low-pressure gas discharge lamp as claimed in claim 1, characterized in that the gas filling comprises, as an additive, a halogenide of copper and a halogenide of thallium in the molar ratio of 1:1.

* * * * *